US006623007B2

(12) United States Patent
Logue

(10) Patent No.: US 6,623,007 B2
(45) Date of Patent: Sep. 23, 2003

(54) MULTI-PIECE 3-D STRUCTURE OF AN IMAGE WITH RELEASABLE FRICTION-INTERLOCK

(76) Inventor: William M. Logue, 2399 W. Vista Dr., Larkspur, CO (US) 80118-7602

( * ) Notice: Subject to any disclaimer, the term of this patent is extended or adjusted under 35 U.S.C. 154(b) by 49 days.

(21) Appl. No.: 09/952,674

(22) Filed: Sep. 14, 2001

(65) Prior Publication Data

US 2003/0062674 A1 Apr. 3, 2003

(51) Int. Cl.[7] ..... A63F 9/08

(52) U.S. Cl. ..... 273/156; 273/153 S; 446/108

(58) Field of Search ..... 273/156, 157 R, 273/153 P, 153 S; 446/108, 115, 124

(56) References Cited

U.S. PATENT DOCUMENTS

| | | | | |
|---|---|---|---|---|
| D138,214 S | | 7/1944 | Miller | D25/1 |
| 2,443,468 A | * | 6/1948 | Madden | 434/304 |
| 2,861,358 A | | 11/1958 | Ward | 35/71 |
| 2,923,551 A | | 2/1960 | Pope | 273/157 |
| 3,107,918 A | | 10/1963 | Edlen | 273/157 |
| 3,596,380 A | | 8/1971 | Williams | 35/77 |
| 3,981,506 A | | 9/1976 | Daniel et al. | 273/157 R |
| D243,783 S | | 3/1977 | Kleinman et al. | D34/15 M |
| 4,257,606 A | | 3/1981 | Launzel | 273/157 R |
| 4,332,387 A | | 6/1982 | Mullen, III | 273/156 |
| 4,428,581 A | | 1/1984 | Nagorny | 273/153 S |
| 4,496,155 A | | 1/1985 | Goldfarb | 273/153 S |
| 4,666,162 A | | 5/1987 | Campbell | 273/249 |
| 4,874,176 A | | 10/1989 | Auerbach | 273/157 R |
| 5,100,359 A | | 3/1992 | Gorio | 446/124 |
| 5,251,900 A | | 10/1993 | Gallant | 273/157 R |
| 5,286,026 A | | 2/1994 | Schnapp | 273/155 |
| 5,409,227 A | * | 4/1995 | Walker | 273/157 R |
| 5,452,895 A | | 9/1995 | Ray | 273/153 S |
| 5,810,356 A | | 9/1998 | Green | 273/157 R |
| 5,823,533 A | | 10/1998 | Edwards | 273/160 |
| 5,860,650 A | | 1/1999 | Scobbie et al. | 273/157 R |

(List continued on next page.)

FOREIGN PATENT DOCUMENTS

| | | |
|---|---|---|
| DE | 1800509 | 2/1970 |
| DE | 2164608 | 6/1973 |
| GB | 2207360 A | 2/1989 |

OTHER PUBLICATIONS woodcraftplans.com Product Search Report for "scrollsaw" [online] [retrieved Aug. 19, 2001] Retrieved from Internet <URL: http://store.woodcraftplan.com/Search.bok>.

(List continued on next page.)

*Primary Examiner*—Kien T. Nguyen
(74) *Attorney, Agent, or Firm*—Macheledt Bales LLP

(57) ABSTRACT

A plurality of relatively rigid elements for arrangement into a three-dimensional (3-D) structure that represents an image; also a method for arranging a plurality of relatively rigid elements into a 3-D structure. Each element has a base-thickness and comprises a top surface, an undersurface, and a wall-surface around its perimeter. The perimeter of each of the elements yielding the image, is shaped to represent a component of the image. The elements are adapted for initial arrangement wherein a juxtaposed wall-surface of each adjacent element comprises a beveled plane. In the initial arrangement, the undersurface of two or more elements can be arranged in a pattern of the image such that beveled planes of juxtaposed wall-surfaces are frictionally-unlocked. The elements are also adapted for positioning into the 3-D structure wherein at least a portion of juxtaposed beveled planes are in releasable friction-interlock and top surfaces of elements are tiered with respect to any adjacent element(s). Images for the 3-D structures can be selected from a wide variety of recognizable images as well as abstract graphic images. Beveled planes of juxtaposed wall-surfaces matched for releasable friction-interlock can be oriented as a declining and inclining sloped pair, or vice versa.

21 Claims, 6 Drawing Sheets

U.S. PATENT DOCUMENTS

| | | | | | |
|---|---|---|---|---|---|
| 5,895,044 | A | | 4/1999 | Bahramian | 273/157 R |
| 6,029,974 | A | | 2/2000 | Povitz | 273/157 R |
| 6,073,929 | A | * | 6/2000 | Nahon | 273/156 |
| 6,086,067 | A | | 7/2000 | Benoît et al. | 273/157 R |
| 6,152,797 | A | * | 11/2000 | David | 446/115 |

OTHER PUBLICATIONS

Pictures of Intarsia work done by G. Case, R. Cloutier and R. Scarlett [online] [retrieved Aug. 19, 2001] Retrieved from Internet: <URLs:http://www.saw–online.com/Gallery/Project/Garnet%20Case/Garent%20Case.htm, http://www.saw–online.com/Gallery/Project/Garnet%20Case/Deer%20Intarsia.htm, :http://www.saw–online.com/Gallery/Project/Ront%20Cloutier/StaringWolf.ipg, :http://www.saw–online.com/Gallery/Project/Ron%20Cloutier/Ron%20Clotier.htm, :http://www.saw–online.com/Gallery/Project/Richard%20Scarlett/Richard%20Scarlett.htm, :http://www.saw–online.com/Gallery/Project/Richard%20Scarlett/Intarsian%20bear.ipg.

Step by step Instructions for Getting started Scrollsawing with Scroller, Ltd. [online] [retrieved Aug. 19, 2001] Retrieved from Internet: <URL: http://scrollerltd.com./get-star.htm>.

Better Homes and Gardens (1993), *Wood Scrollsaw Techniques and Projects You Can Make*, "Sign–Making Made Easy" pp. 22–27.

Baumeister, Theodore (1958: 7$^{th}$ Edition) *Standard Handbook for Mechanical Engineers,* "Friction of Machine Elements" pp. 3–40 through 3–43.

Lardner, Thomas J. (1978: 2$^{nd}$ Edition with SI Units) *An Introduction to the Mechanics of Solids,* "Fundamental Principles of Mechanics" pp. 21–27.

* cited by examiner

MULTI-PIECE 3-D STRUCTURE OF AN IMAGE WITH RELEASABLE FRICTION-INTERLOCK

BACKGROUND OF THE INVENTION

In general, the present invention relates to multi-piece ornamental, educational, and puzzle-type arrangements that can be assembled into three-dimensional (3-D) configurations. More particularly, the invention relates to unique 3-D structures that represent an image arranged from elements having a top surface, an undersurface, and a wall-surface around each element's perimeter, wherein the elements yielding the imaged are generally shaped to represent components of the image. These novel elements, as designed, allow for an initial arrangement wherein a juxtaposed wall-surface of each adjacent element comprises a beveled plane. The elements can be further manually arranged into novel 3-D structure(s) wherein at least a portion of the juxtaposed beveled planes are in releasable friction-interlock and the top surfaces of adjacent elements are tiered. Also, the invention relates to a method of arranging relatively rigid elements into such 3-D structures by slidably positioning the elements along their juxtaposed beveled planes into a releasable frictional-interlock; thereafter, the frictional-interlock may be manually released so adjacent elements can be returned to an initial 'loose' arrangement where the beveled planes are frictionally unlocked, and further separated as desired.

Multi-piece puzzles have been around preoccupying human beings for centuries. By far the most common is the picture puzzle containing dovetailed-type jointed members, such as those shown in U.S. Pat. Nos. 6,086,067 and 5,860,650 interconnected into a 3-D castle. More often, dovetailed-type jointed picture puzzles are assembled atop a flat surface such as a coffee table. Quite different from the traditional picture puzzle is the instant invention. According to the invention, the releasable friction-interlock feature of juxtaposed beveled planes allows elements shaped into components (that yield, when arranged, an image) to be slid into a tiered 3-D structure of that image. Though at first glance, the images assembled using the elements of the invention appear to have visual similarities to those found in wooden mosaic-like intarsia plaques created using a scroll-saw to cut out shapes from wood which are permanently glued together in ornamental fashion, a closer look reveals that the unique elements of the invention assembled into the 3-D structures disclosed herein are dramatically different. Traditionally, intarsia pieces are cut from different types of wood of differing thicknesses selected according to its final thickness within the finished, glued-together plaque. Intarsia plaques are merely wooden 3-D mosaic-like inlays that are permanently glued for ornamental use. Another type of inlaid ornamental plaques is referred to as 'marquetry' created by slightly tilting a scrollsaw table to saw a taper between inlay pieces which are then press-fit together with adhesive therebetween to form permanent bonds between the pieces. The end product scrollsawn marquetry is an image permanently inlaid in mosaic-fashion planed flat on top. Plaques constructed into intarsia or as marquetry are not meant to be disassembled.

As one can see, unlike conventional puzzles and educational toys, the innovative elements adapted for arrangement into frictionally-interlocked 3-D structures of pre-selected images, as well as the associated technique of so arranging according to the invention, provide for continued assembly and disassembly of the elements in a visually appealing manner. In the spirit of design goals contemplated hereby, many different types of materials, fabrication/molding/machining techniques, and many different image patterns representing inanimate objects (vehicles, buildings, bikes, and so on), celestial bodies (planets, comets, stars, and the like), maps (street-city, country, state, world, topographic, etc.), mammals, plants, and their bio-components (skeletons, cell structure, etc.), and a whole host of miscellaneous graphic designs (including abstract designs), can be incorporated to create applicant's unique 3-D structures, as will be further appreciated.

SUMMARY OF THE INVENTION

It is a primary object of this invention to provide a plurality of elements for temporary arrangement into a 3-D structure that represents an image, each element having a wall-surface around its perimeter. Elements are adapted to be initially arranged adjacent one another into a pattern of the image such that certain of the wall-surfaces are juxtaposed but not in friction-interlock. These juxtaposed wall-surfaces each comprise a beveled plane such that, to create a 3-D structure of the invention, at least a portion of the beveled planes of juxtaposed wall-surfaces are in releasable friction-interlock. When arranged in a 3-D structure according to the invention, the top surfaces of the frictionally-interlocked adjacent elements are tiered with respect to each other. The 3-D structures can be disassembled by releasing frictionally-interlocked beveled planes allowing the elements to return to an initial arrangement. The loosely arranged elements within an initial unlocked arrangement can be further separated for subsequent reassembly and/or storage.

Elements of the invention can be of a multitude of shapes and sizes so that when arranged, the elements yield any of a variety of images; these images may be of a recognizable shape as well as of abstract images. One or more of the elements may be composed of integral sub-pieces ornamentally inlaid, affixed/glued, hot-melded/thermally bonded, or otherwise adhered in mosaic fashion to yield a component of the overall image.

The advantages of providing the new elements and technique for arranging into 3-D structures of the invention include: (a) simplicity of design; (b) ease of assembly and disassembly; (c) flexibility of use—assembled 3-D structures can be used in an ornamental manner, or a kit comprising several elements can be used as a puzzle for recreational and educational purposes (e.g., to sharpen fine motor skills or for image recognition); (d) relative ease of, and reproducibility in, fabricating elements which can lead to cost-effective bulk manufacture and assembly of elements into kits for their distribution and sale; (e) ease of adapting a multitude of familiar images into 3-D structures of the invention by first breaking down a selected image into components of the image and fabricating elements into shapes that represent those components; and (f) versatility in design—kits can be assembled containing certain elements 'common' to several different creatable images along with elements shaped to be interchangeable—i.e., 'core' elements common to several image designs, can be used in combination with alternate elements to create different overall images when arranged with the interchangeable elements. These and other advantages plus a better understanding of the distinguishing features of the instant invention, as described and supported by this disclosure, will be readily appreciated.

Briefly described, once again, the invention includes a plurality of elements for arrangement into a three-dimensional (3-D) structure that represents an image. Each of the elements has a base-thickness and comprises a top surface, an undersurface, and a wall-surface around its perimeter. The perimeter of each of the elements yielding the image, is shaped to represent a component thereof. The elements are adapted for initial arrangement wherein a juxtaposed wall-surface of each adjacent element comprises a beveled plane. In the initial arrangement, the undersurface of each element can be arranged in a pattern of the image atop a generally planar surface such that beveled planes of juxtaposed wall-surfaces are frictionally-unlocked. The elements, being preferably relatively rigid, are also adapted for positioning into the 3-D structure wherein at least a portion of juxtaposed beveled planes are in releasable friction-interlock and top surfaces of each element is tiered with respect to any adjacent element(s).

Images for the 3-D structures can be selected from a very wide variety of recognizable images such as an image of a map (street, city, state, country, region, world, etc.), a mammal (for example, in an educational puzzle, this might include the face, bust or profile of a famous person, any portion or the whole of an animal, a skeleton, praying hands, a dove, feet, and so on), a plant, an inanimate object (for example, if a child's toy, may choose any of a number of vehicles recognizable by a child of a selected age-range, such as a train, boat, plane, car, motorcycle, bike, spacecraft; or the image may be of an action-figure such as superman/woman, a cartoon characters, or holiday figure; etc), a geographic feature (such as a scene or topographic map comprising any one or more of the following: mountain, lake, river/stream, canyon, glacier, ocean, hill, and so on), and any celestial body; or the image may be of an abstract graphic design (for example, corporate logo, graphic of famous art, and so on).

Elements may be made from a variety of materials such as wood (this category includes wood derivatives), polymer resins, fiberglass, ceramic, glass, stone, metal, alloys, and polymeric materials. The planes of juxtaposed wall-surfaces can be beveled at an angle between 0.5-degrees to 18-degrees from vertical, and preferably within a range of about 1-degree to 11-degrees from vertical; the particular angle selected for each beveled plane will depend upon the material of respective juxtaposed wall-surfaces in friction-interlock. The cross-section of the elements can be of a variety of shapes. The beveled planes of juxtaposed wall-surfaces matched for releasable friction-interlock will be oriented oppositely as a declining and inclining sloped pair, the particular orientation of each matched pair to depend upon directional movement of respective adjacent elements into the releasable friction-interlock position. For example, within a 3-D structure, certain of the elements might require a push in an upwardly direction into friction-interlock while other of the elements within the same 3-D structure are pushed downwardly—resulting in a structure with several different levels of tiers among internally located elements that yield the image. In any case, preferably upon releasing the friction-interlock of adjacent elements, they can be returned to an initial arrangement.

By way of example, a 3-D structure as characterized, includes a first of the elements at least partially surrounded by a second of the elements—the second element being interposed between this first element and a fifth element. This fifth element can be designed such that it frames the image. A beveled plane around the first element is sloped such that an edge-perimeter around the undersurface of the first element is greater than an edge-perimeter around its top surface. A third element is surrounded by the first element; a beveled plane around the third element is sloped such that an edge-perimeter around the undersurface of this third element is smaller than an edge-perimeter around its top surface. A fourth element is likewise surrounded by the first element; a beveled plane around the fourth element is likewise sloped: an edge-perimeter around its undersurface is smaller than an edge-perimeter around its top surface.

A base-thickness, t, is referenced and identified for the elements; it extends generally between the undersurface and a top surface of an element. The base-thicknesses of each element in a 3-D structure may be approximately equal, or the elements within a particular 3-D structure may be of varying base-thicknesses. The top surface of any of the elements may be contoured to coincide with features of the image. One or more of the elements may be composed of integral sub-pieces ornamentally inlaid, affixed/glued, hot-melded/thermally bonded, or otherwise adhered in mosaic fashion to yield a component of the overall image.

In another characterization of the invention, the plurality of elements are arranged into a 3-D structure that represents an image. Once again, each element has a base-thickness and comprises a top surface, an undersurface, and a wall-surface around a perimeter; a juxtaposed wall-surface of each adjacent element comprises a beveled plane, at least a portion of which is in releasable friction-interlock; the perimeter of each of the elements yielding the image is shaped to represent a component thereof; and top surfaces of each element is tiered with respect to an adjacent element.

Also characterized is an associated method of arranging a plurality of relatively rigid elements into a three-dimensional structure that represents an image. First of all, each of the elements is provided with a top surface, an undersurface, and a wall-surface around a perimeter; whereby the perimeter of each of the elements yielding the image, is shaped to represent a component of the image. Next, the elements are arranged in an initial arrangement such that a beveled plane of the wall-surface of each adjacent element is juxtaposed. Then, adjacent elements are slidably positioned along their juxtaposed beveled planes into a releasable frictional-interlock of the structure wherein the top surface of each adjacent element is tiered with respect to its adjacent element(s). Additionally, upon releasing the frictional-interlock, the elements can be returned to their frictionally-unlocked initial arrangement. Features pointed out above in connection with elements that can be arranged into 3-D structures of the invention, are accommodated by the method of the invention.

BRIEF DESCRIPTION OF THE DRAWINGS

The accompanying drawings illustrate the innovative nature plus the flexibility of design and versatility of preferred and alternative structures of the invention, as well as the method of the invention. One will appreciate the unique features of the invention by reviewing these drawings (in which like numerals designate like parts), included to communicate the innovative nature and features of the invention by way of example, only, and are in no way intended to unduly limit the disclosure hereof.

in FIG. 4, arrangement 40A has three concentric elements and in FIG. 5 arrangement 50A has two concentric elements. As shown in these arrangements 40A and 50A, juxtaposed beveled planes are not in friction-interlock.

DETAILED DESCRIPTION OF THE PREFERRED EMBODIMENTS AND ALTERNATIVES

Figure 1:
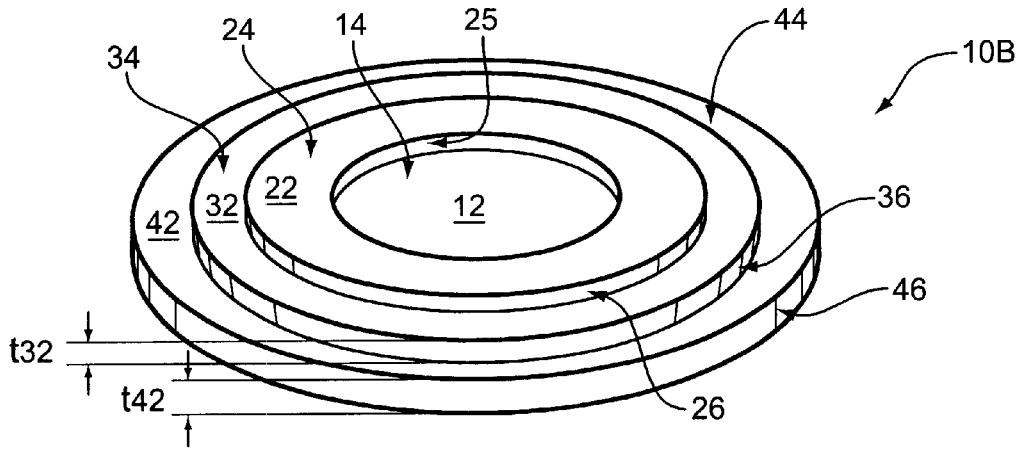
FIG. 1 is a perspective depiction of a 3-D structure of the invention (labeled 10B) having concentric elements 12, 22, 32, 42 with tiered top surfaces, respectively labeled 14, 24, 34, and 44.
Figure 2:
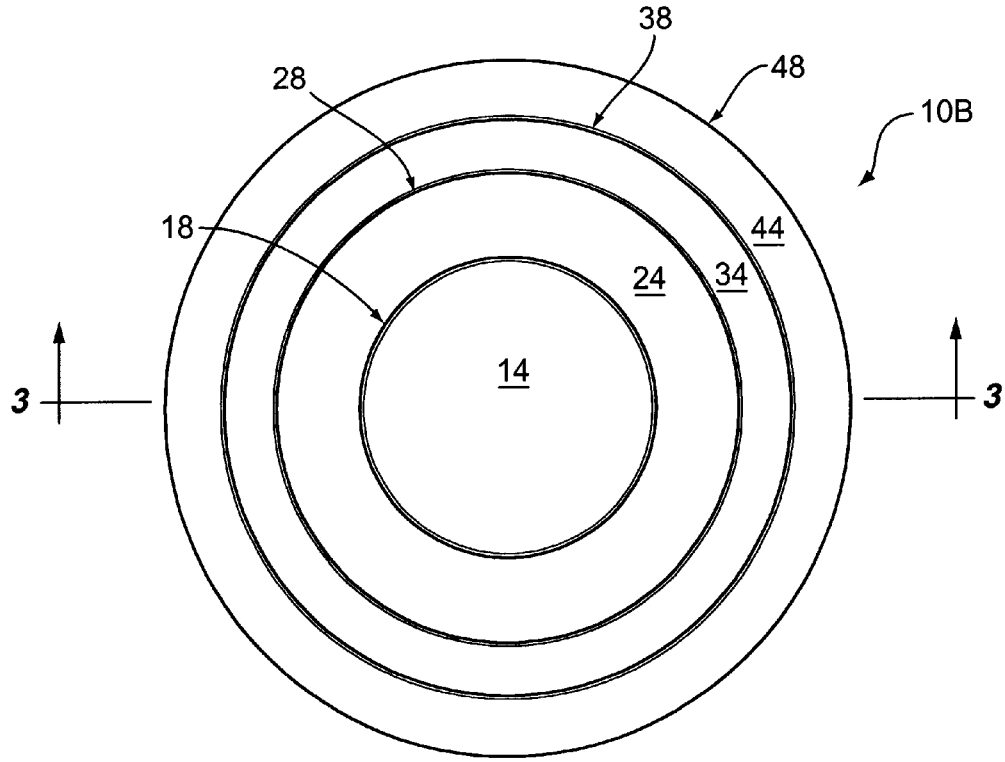
FIG. 2 is a top plan view of the structure (10B) in FIG. 1.

As illustrated in the perspective view of the 3-D structure 10B of FIG. 1, one can see that concentric elements 12, 22, 32, 42 each have a top surface, respectively labeled 14, 24, 34, and 44, which is tiered with respect to any adjacent elements. For reference, a base-thickness, $t_{32}$ and $t_{42}$, has been labeled for each of the elements 32 and 42. Also labeled in the FIG. 1 perspective is an inner wall-surface 25 of element 22 and outer wall-surfaces 26, 36, 46 of elements 22, 32, 42, respectively. As contemplated and according to the invention, the abstract circular shape of 3-D structure 10B is by way of example only; although one can appreciate that each element 12, 22, 32, 42 as arranged, complements one another to produce the full concentric circular image of structure 10B. For reference, the top surfaces 14, 24, 34, 44 of concentric elements of structure 10B are bounded respectively by perimeters 18, 28, 38, 48 in the top plan of FIG. 2.

Figure 3:
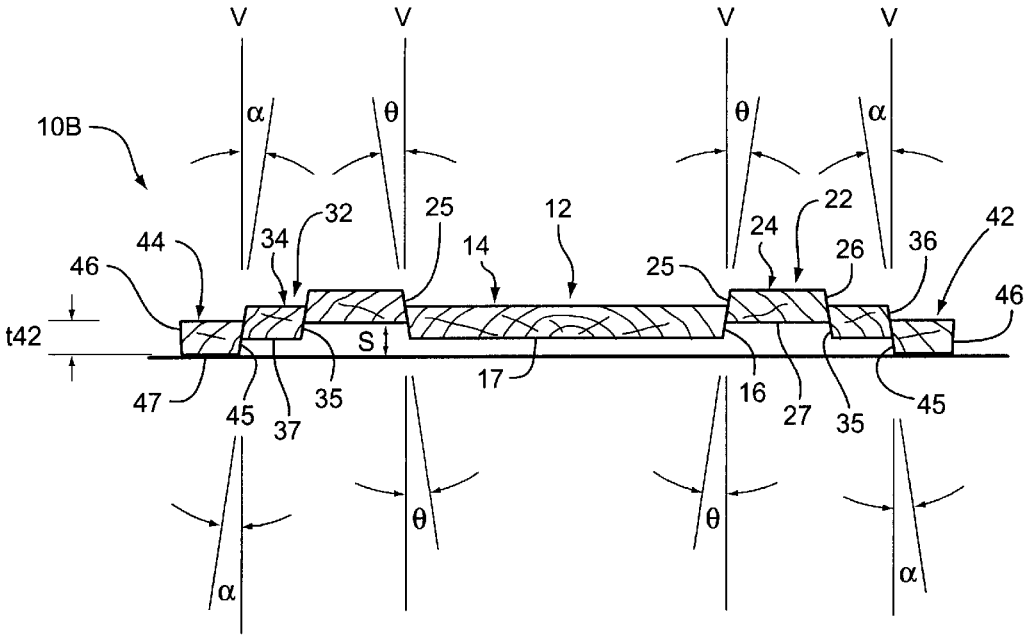
FIG. 3 is a sectional view taken along 3—3 of FIG. 2, illustrating the tiered nature of adjacent top surfaces and beveled planes of juxtaposed wall-surface pairs (e.g., 16 and 25, 35 and 26, 45 and 36) in a friction-interlock position.

FIG. 3 further details the friction-interlock position of juxtaposed beveled planes and resulting tiered relationship of the top surfaces (such as between 14, 24, 34 and between 24, 34, 44) of respective adjacent elements (12, 22, 32 and 22, 32, 42). Pairs of juxtaposed beveled planes of adjacent wall-surfaces in friction-interlock here, include: beveled planes 36–45 between elements 42 and 32; beveled planes 26–35 between elements 32 and 22; and beveled planes 16–25 between elements 22 and 12. As can be best seen in FIG. 3, the beveled plane of each juxtaposed wall-surface of structure 10B extends the full length of the wall-surface. This need not be the case, as will be further explained in connection with the sectional views shown in FIGS. 5 and 8. The beveled planes of juxtaposed wall-surfaces need only extend as far along a respective wall-surface (e.g., FIG. 5, element 92 bevel—pair 99) so as to provide friction-interlock therebetween when slidably moved into place to form the 3-D structure of the image. In FIG. 3, since the base-thickness of each element 12, 22, 32, 42 is approximately equal to that labeled for element 42 (i.e., $t_{42}$) the undersurfaces 17, 27, 37, and 47 of each element are tiered; the largest spacing from the surface on which structure 10B is placed, is labeled s for reference. For example, elements of a structure of the invention having been cut, sawed, machined, or otherwise fabricated from the same piece of material of uniform thickness (wood, fiberboard, plastic, etc.), will have approximately equal base-thicknesses.

By way of background reference: Friction forces are set up whenever a tangential force is applied to a body pressed normally against the surface of another. The friction force arises from the interaction of the surface layers of bodies pressed against one another. In the case where there is no relative motion between a body A and another body B, the friction force F is defined equal and opposite to an applied tangential force T—a condition which can be maintained for magnitudes of T between zero and a certain limiting value, $F_s$ (referred to as static friction force). If $T>F_s$, then sliding will occur. In the case where body A slides along body B in the direction of tangential force T, the friction force F acting on body A will have a direction opposite to the velocity of A relative to B, and its magnitude will be $F_k$ (referred to as kinetic friction force). Introducing two constants of proportionality $f_s$ and $f_k$ (called the static and kinetic coefficients of friction—which are intrinsic to the interface between the materials out of which bodies A and B are made as well as the state of lubrication or contamination at the interface), one can then write the following regarding the force normal to interface, N:

$$F_s=f_sN \quad \text{Eqn. 1}$$

$$F_k=f_kN \quad \text{Eqn. 2}$$

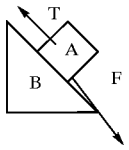

As explained further in "An Introduction to the Mechanics of Solids", $2^{nd}$ Ed., McGraw-Hill Book Co., T. Lardner, Editor (1978), the coefficients of friction vary considerably depending upon the material and surface conditions (e.g., lubricated vs. unlubricated):

TABLE 1

| Material | Surface Conditions | $f_s$ | $f_k$ |
|---|---|---|---|
| Metal on metal | Carefully cleaned | 0.4–1.0 | 0.3–1.0 |
| (e.g., steel on steel, | Unlubricated | 0.2–0.4 | 0.15–0.3 |
| copper on aluminum) | Well-lubricated | 0.05–0.12 | 0.05–0.12 |
| Nonmetal on non-metal | Unlubricated | 0.4–0.9 | 0.3–0.8 |
| | Well-lubricated | 0.1–0.2 | 0.1–0.15 |
| Metal on non-metal | Unlubricated | 0.4–0.6 | 0.3–0.5 |
| | Well-lubricated | 0.05–0.12 | 0.05–0.12 |

By way of further background, "Standard Handbook for Mechanical Engineers", $7^{th}$ Ed., T. Baumeister, Editor, McGraw-Hill Book Co. (1958), pp. 3–41 to 3–42, diagrammatically illustrates static and kinetic forces acting on taper keys that are self-locking when certain physical conditions of two interacting bodies having tapers are met. Use of locking tapers, or taper keys that are self-locking, has been reserved in connection with the design of fastening means such as bolts, screws, plugs, dowels, and the like, to aid in creating more-permanent fastening joints.

One can readily appreciate the flexibility of the invention in connection with FIGS. 3–9 and 11 depicting alternative structural configurations for elements arranged according to the invention. Returning to FIG. 3, an angle from vertical has been labeled for reference in each of two of the pairs of juxtaposed beveled planes in friction-interlock: the bevel of planes 36–45 between elements 42 and 32 is at an angle $\alpha$ from vertical V, and the bevel of planes 16–25 between elements 22 and 12 is at an angle $\theta$ from vertical V. Friction-interlock for the wooden elements shown here, can occur if the reference angles labeled $\alpha$ and $\theta$ are preferably selected from a range of about 1-degree to 11 degrees. By way of example only, in a 3-D structure of a bear's head such as that shown in FIGS. 11 and 12 built from pine, the juxtaposed planes were beveled at angles $\alpha$ and $\theta$ of approx 7-degrees. Note that, depending upon the coefficient of friction at the interface of pairs of juxtaposed beveled planes (related to the surface material, and level of smoothness, etc.) and depending upon how rigid the elements are (related to base-thickness, material stiffness, and overall shape, etc.) the bevel may vary from 0.5-degrees from vertical to 18-degrees from vertical. Preferably the friction-interlock is one that can be released with manually-applied pressure (whether applied by the small hands of a child or those of an adult) so that the elements of a 3-D structure can be manually separated and returned, if desired, to a receptacle or box for storage and later use.

Figure 4:
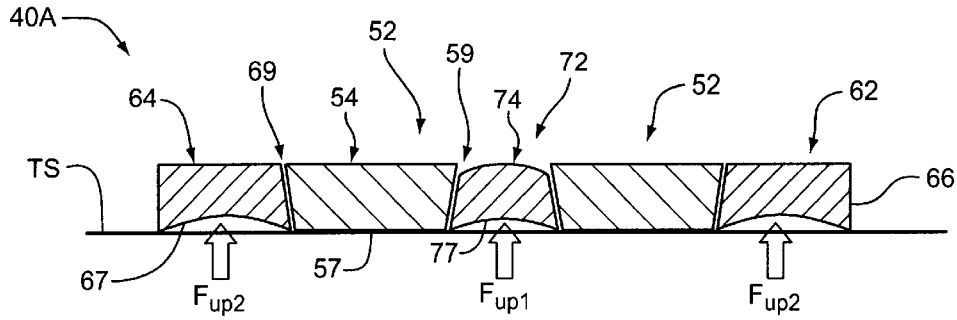
FIGS. 4 and 5 are sectional views of several elements of the invention in an initial arrangement.

The arrangement 40A of FIG. 4 has three elements 72, 62, and 52. Top surfaces 64 and 54 and undersurface 57 are generally planar; and top surface 74 and undersurface 77 of central element 74, as well as undersurface 67, are contoured. Here, as shown, the pairs of juxtaposed beveled planes labeled 69 and 59 are not in friction-interlock. The pair of beveled planes at 59 is oriented such that central element 72 is pushed in an upwardly direction with a force (labeled $F_{up1}$ for reference) in order to reach a friction-interlock. Likewise, the pair of beveled planes at 69 is oriented such that outer element 62 is pushed in an upwardly direction with a force (labeled $F_{up2}$ for reference) in order to reach a friction-interlock. While exterior wall-surface 66 of element 62 is shown to have a slight bevel, it is not necessary unless an additional element(s) is to be frictionally-locked thereto. The table surface TS on which the arrangement 40A rests in FIG. 4 is shown, by way of example only, as a generally planar surface. The surface TS may be contoured to match the contour of the undersurfaces of elements in an unlocked arrangement: a slightly-arced surface TS may support undersurfaces similarly arced. The contour of undersurfaces 67 and 77 (of elements 62 and 72) are indented such that fingers of a child, for example, can easily locate and identify the direction of movement necessary to slide respective elements 62 and 72 into friction-interlock.

Figure 5:
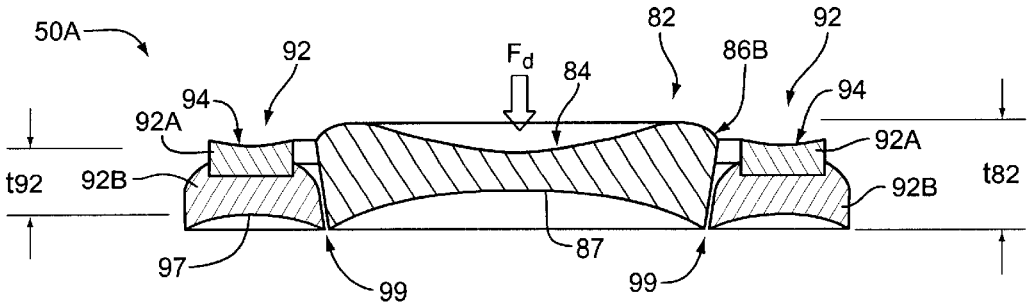

The arrangement 50A of FIG. 5 has two elements 82 and 92. Top surface 84 of element 82 is contoured and indented to directionally-accommodate the force $F_d$ that will be manually applied to slide element 82 along pair of juxtaposed beveled planes (at 99) and into friction-interlock with element 92. Element 92 has an integral sub-piece 92A ornamentally inlaid, affixed/glued, hot-melded/thermally bonded, or otherwise adhered in mosaic fashion to sub-piece 92B; the two sub-pieces, together, yield a component of the overall image. Whether or not the sub-pieces are fabricated of different materials, a compatible adhesive mechanism is used to permanently bond together the sub-pieces, so that when arranged into a 3-D structure, the image is created by the complement of the inlaid sub-pieces in friction-interlock with adjacent elements. The base-thickness of each element 82 and 92 is referenced respectively at $t_{82}$ and $t_{92}$ and they are not equal. The undersurfaces 87 and 97 as well as top surface 94 are contoured. The wall-surface of element 82 has an upper curvilinear labeled 86B and bevel plane 86A (see FIG. 6).

Figure 6:
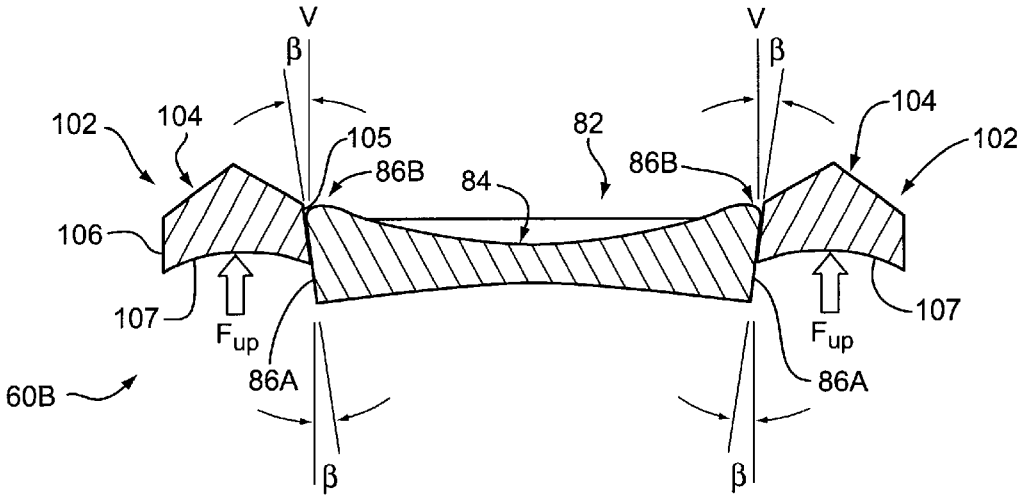
FIGS. 6 through 8 are sectional views of alternative 3-D structures of the invention arranged and respectively labeled 60B, 70B, and 80B, whereby beveled planes are in friction-interlock. Top surfaces of adjacent elements are accordingly, tiered.
Figure 7:
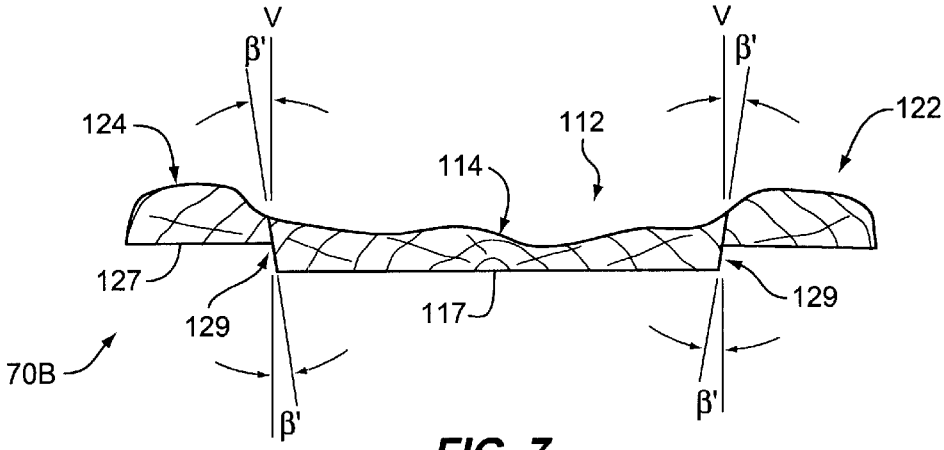

Turning now to FIG. 6, element 82 is paired with element 102 having a contoured top surface 104 and a contoured undersurface 107 upon which manual force $F_{up}$ has been applied to position the elements into the 3-D structure labeled 60B. Juxtaposed planes 86A (i.e., the lower portion of the perimeter wall-surface of element 82) and 105 (of element 102) are beveled at an angle identified as $\beta$ from vertical V. In FIG. 7, element 112 has been paired with element 122, both of which have contoured top surfaces 114 and 124 and generally planar undersurfaces 117 and 127. The pair of juxtaposed beveled planes at 129 are at an angle $\beta'$ from vertical V and are in friction-interlock forming the 3-D structure labeled 70B.

Figure 8:
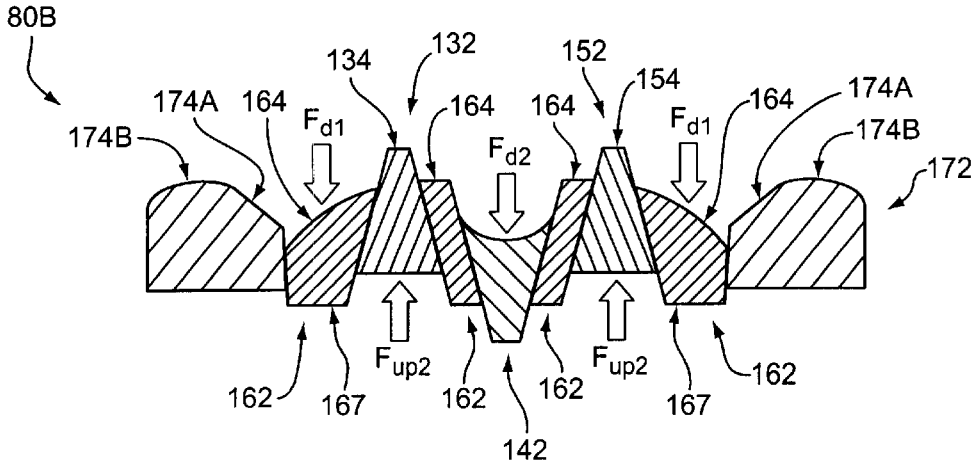

The sectional drawing FIG. 8 illustrates a 3-D structure 80B with several elements: element 142 is surrounded by element 162 which also surrounds each element 132 and 152; in turn, element 162 is surrounded by element 172 having a contoured top surface comprised of plane 174A and surface 174B. Top surfaces of adjacent elements are tiered with respect to one another, as identified moving from the left-hand side of FIG. 8 to the right: 174A/B and 164; 164 and 134; 134 and 164; 164 and the top surface of central element 142 (to which a force $F_{d2}$ was applied in a downwardly direction into friction-interlock); 164 and 154; and 154 and 164. For reference as identified in FIG. 8, forces can be manually applied to the elements so as to position juxtaposed beveled planes into releasable-interlock, thus forming the 3-D structure 80B, as follows: a force $F_{up2}$ was applied in an upwardly direction to the undersurface of element 132, $F_{up2}$ was likewise applied upwardly to the undersurface of element 152, and $F_{d1}$ was applied downwardly to top surface 164 (also labeled is undersurface 167 of 162). Once a pair of juxtaposed planes reach friction-interlock with the application of a gentle manual pressure applied in an opposite direction, the releasable interlock may be 'undone' so that elements may be unattached and separated.

Figure 9:
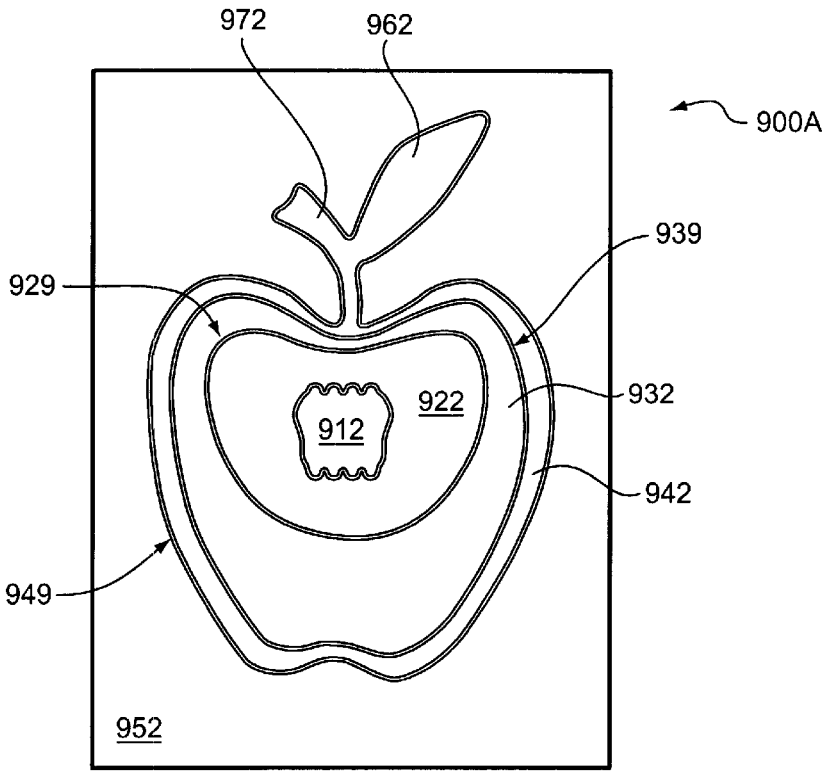
FIG. 9 is a top plan depicting a plurality of elements 900A initially arranged in the image of an apple. The elements are shaped in a complementary manner as components of the image. Here, as in FIGS. 4 and 5, beveled planes of juxtaposed wall-surfaces are not in friction-interlock.
Figure 10:
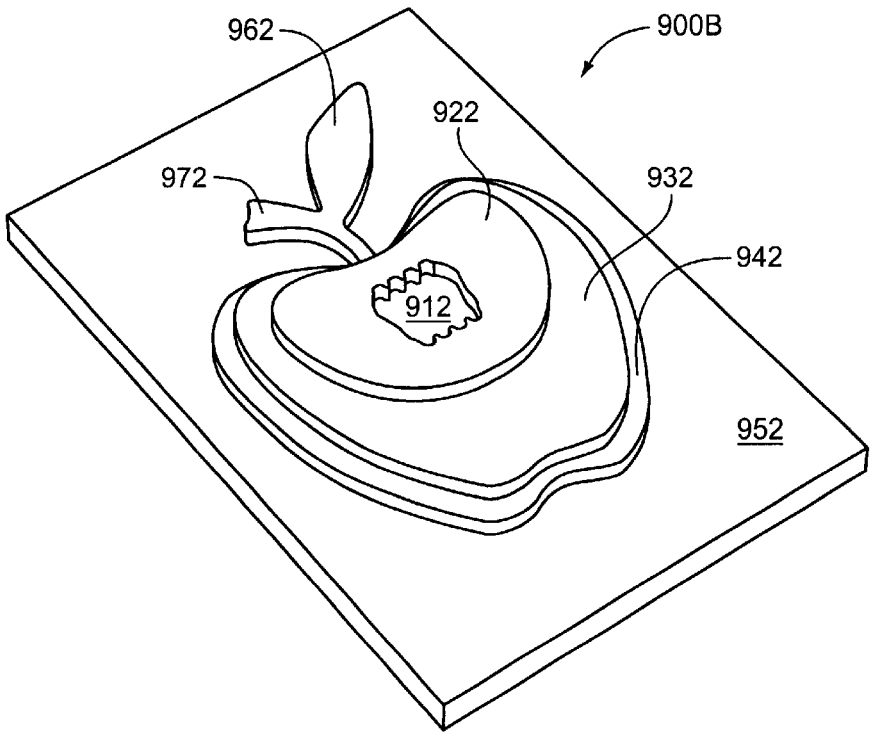
FIG. 10 is a perspective illustration of the elements arranged and frictionally-interlocked as a 3-D structure (labeled 900B) in the image of the apple of FIG. 9.

FIGS. 9 and 10 illustrate an example alternative embodiment having six elements in complement as arranged in FIG. 9 yielding an image of an apple, with an additional outer element 952 framing the image. More-specifically, each element of the arrangement 900A (FIG. 9) and the frictionally-interlocked 3-D structure 900B (FIG. 10) is shaped in a complementary manner as components of the image of the apple. The elements yielding the apple image have been labeled for reference as 912, 922, 932, 942, 962, and 972, with the additional element 952 framing the image.

Figure 11:
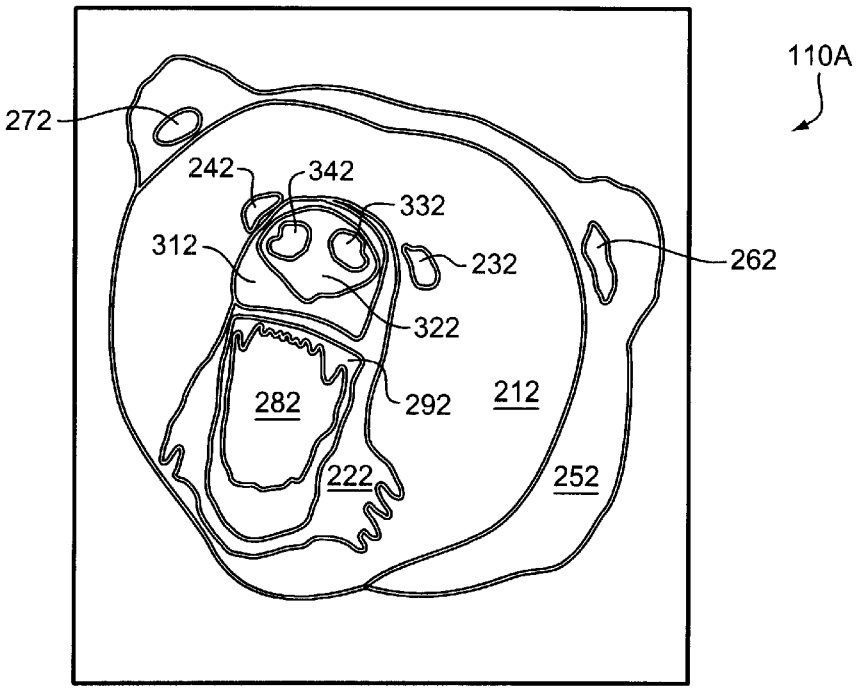
FIG. 11 is a top plan depicting a plurality of elements 110A initially arranged in the image of the head of a bear. The elements are shaped in a complementary manner as components of the image. Here, as in FIGS. 4, 5, and 9, beveled planes of juxtaposed wall-surfaces are not in friction-interlock.
Figure 12:
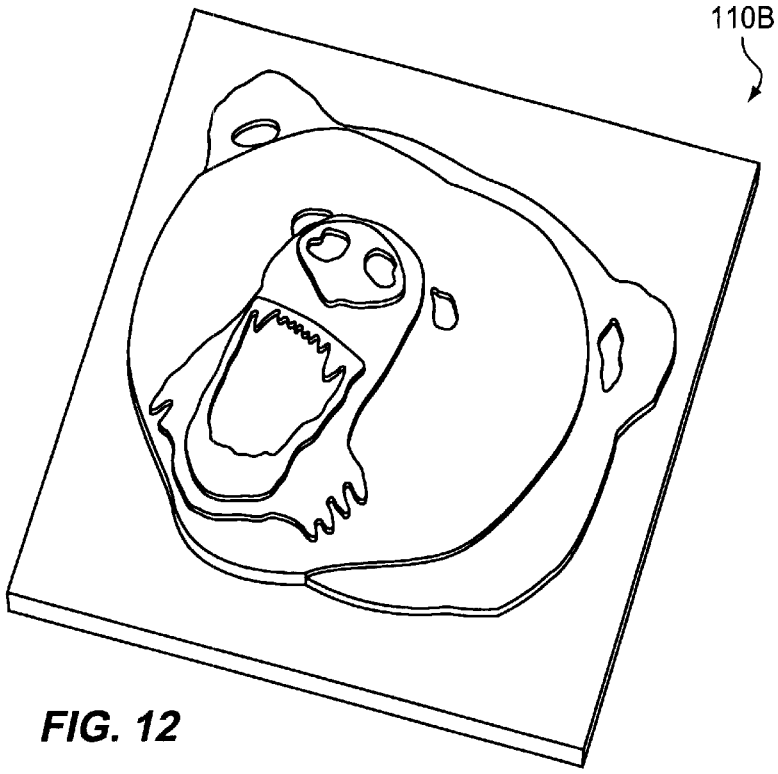
FIG. 12 is a perspective illustration of the elements arranged and frictionally-interlocked as a 3-D structure (labeled 110B) in the image of the bear's head of FIG. 11.

FIGS. 11 and 12 illustrate an example alternative embodiment having thirteen elements in complement as arranged in FIG. 11 yielding an image of a bear head, with an additional outer element (not labeled) framing the image. Each element is shaped to complement one another, as arranged in the bear head image shown at 110A, and once positioned into the 3-D structure 110B (FIG. 12), the tier relationship of adjacent complementary elements can further enhance the features of the image. For example, the nostrils 332 and 342, the eyes 232 and 242, the ear-buds 262 and 272, and the mouth opening 282 may be tiered at a level lower than the top surface of adjacent elements; and to enhance the contour feature of the nose-mouth area, top surfaces of adjacent elements 222, 292 and 312 can be tiered in a stepwise upwardly direction as shown in FIG. 12. Likewise, returning to FIG. 10, the core of the apple image (element 912) may also be positioned as a tier lower than surrounding element 922 to add interesting contrast to the 3-D structure 900B of the apple image. As one can readily appreciate by reviewing the sectionals of FIGS. 3–8 of elements detailing the angle orientation of associated juxtaposed beveled planes for elements pushed upwardly or downwardly (as the case may be) into 3-D structure position, the elements comprising the 3-D structures of FIGS. 10 and 12 are likewise moved upwardly or downwardly along wall-surface planes oriented according to intended final tier relationship of the top surfaces.

Figure 13:
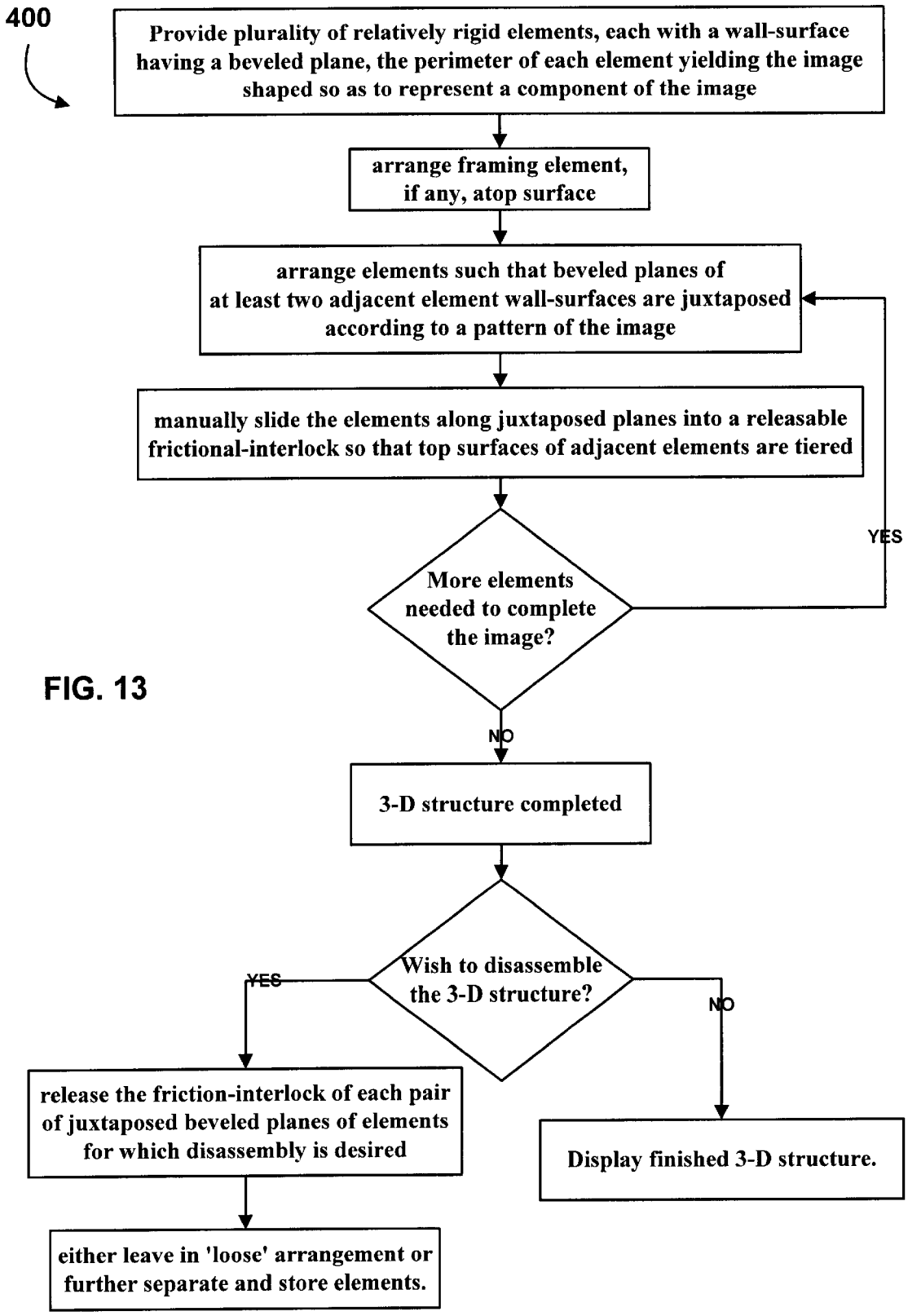
FIG. 13 is a flow diagram depicting features of a method of the invention at 400.

Referring collectively to the figures, and specifically FIG. 13, as one can readily appreciate according to the method of the invention to arrange the relatively rigid elements into a 3-D structure that represents an image (diagrammed and labeled 400 in FIG. 13), the elements can first be arranged in an initial arrangement (for reference, see FIGS. 4, 5, 9, and 11) such that a beveled plane of the wall-surface of at least two adjacent elements is juxtaposed, but not yet frictionally-locked. Then, either from that initial arrangement of a couple of adjacent elements, or from an initial arrangement whereby the undersurface of each element has been arranged into a pattern of the full image (for reference, see FIGS. 9 and 11), adjacent elements are slidably positioned along their juxtaposed beveled planes into a releasable frictional-interlock of the structure (see, for reference, FIGS. 3, 6 through 8, 10, and 12) such that the top surface of adjacent elements are tiered with respect to one another. Upon releasing the frictional-interlock, two-by-two the elements can be returned to a frictionally-unlocked initial arrangement. Such steps, as well as other features of the method of the invention 400, are clearly outlined in the boxes of the simple flow diagram in FIG. 13.

Many lightweight plastics, wood (including wood derivatives), resins, fiberglass, ceramic, glass, stone (such as granite and marble), ductile sheet metals, alloys (such as aluminum alloy), and so on, are suitable for use in fabricating the novel features of the elements of the invention. Preferred materials include those that have sufficient structural integrity to support the friction-interlock engagement along the beveled planes of juxtaposed side-walls into 3-D structures of the invention, and that reasonably resist degradation or discoloration (to preserve the image) which otherwise might result from contact with dirt, moisture, and/or exposure to everyday wear and tear. It is preferred that the elements not exhibit a great amount of elasticity. Suitable plastics include: a thermosetting synthetic allyl resin which can be made optically clear and resists most solvents; a nylon; the thermoplastic ionomer resin (containing both covalent and ionic bonds) used in bottles and toys, and other polymeric (thermoplastic) resins; thermoplastics with at least some impact resistance (and if intended for outdoor use, at least some weatherability) such as those used in making plastic coatings, lenses, and signage; polyethylene, a tough thermoplastic that can be molded, extruded, calendered, cast, and vacuum formed (all according to known fabrication techniques); and so on. Suitable woods include both natural woods and manmade fiberboard/particleboard, plywood, card/hardboard, etc. Although fabrication of the invention is not limited as such, features of the elements (for reference, see the several FIGS.) can be scrollsawn or otherwise cut/sawed, molded, formed, cast, stamped, rolled, or machined to tolerance (dimensioned accordingly) preferably out of a durable relatively rigid material, some elastic deformation is tolerated (that is to say, any deformation that occurs will generally disappear upon release of the manually-applied load/force applied to the material to build the 3-D structures, without breakage or fracture of the elements). Suitable materials for elements shown in the drawings should allow for manual application of force(s) necessary to frictionally interlock beveled planes and likewise unlock the elements (using a sliding-type motion in a downward or upward direction, as the case may be); and if the 3-D structure is intended for outdoor use (for example, one may wish to ornamentally display the 3-D structure), the material used for the elements is preferably somewhat weather-resistant (moisture, temperature, sun, etc.).

By way of background, as is known, for reference only: Whether deformation of any material/body is primarily "elastic" depends upon the size of the load/force and the length of time the load/force is applied. As one increases the load applied to an "elastic-plastic" material shape (one that exhibits both types of deformation), elastic deformation is initially observed, and thereafter, by increasing the load still further a point is reached at which permanent bending/deformation occurs and remains after release of the load (referred to as plastic deformation). Injection molding consists of feeding a plastic compound in powdered or granular form from a hopper through metering and melting stages and then injecting it into a mold. After a brief cooling period, the mold is opened and the solidified part ejected. Many well known techniques exist to inject melted plastics into a mold.

While certain representative embodiments and details have been shown merely for the purpose of illustrating the invention, those skilled in the art will readily appreciate that various modifications may be made without departing from the novel teachings or scope of this invention. Accordingly, all such modifications are intended to be included within the scope of this invention as defined in any claim following this description. Although the commonly employed preamble phrase "comprising the steps of" may be used herein, or hereafter, in a method claim, the Applicants in no way intend to invoke 35 U.S.C. Section 112 ¶6. Furthermore, in any claim that is filed hereafter, any means-plus-function clauses used, or later found to be present, are intended to cover the structures described herein as performing the recited function and not only structural equivalents but also equivalent structures.

What is claimed is:

1. A plurality of elements for arrangement into a three-dimensional structure that represents an image, comprising:

each of the elements has a base-thickness and comprises a top surface, an undersurface, and a wall-surface around a perimeter, said perimeter of each of the elements yielding the image is shaped to represent a component thereof;

the elements adapted for an initial arrangement wherein a juxtaposed wall-surface of each adjacent element comprises a beveled plane; and the elements positioned into the three-dimensional structure wherein at least a portion of said juxtaposed beveled planes are in releasable friction-interlock and said top surface of each said adjacent element is tiered.

2. The plurality of elements of claim 1 wherein: said planes of said juxtaposed wall-surfaces are beveled at an angle between 0.5-degrees to 18-degrees from vertical; and each of the elements is relatively rigid.

3. The plurality of elements of claim 2 wherein said base-thickness of each of the elements is approximately equal, each said beveled plane extends from an edge around said top surface to an edge around said undersurface, and each of the elements is made of a relatively rigid material selected from the group consisting of wood, polymer resins, fiberglass, ceramic, glass, stone, metal, alloys, and polymeric materials.

4. The plurality of elements of claim 2 wherein said initial arrangement comprises said undersurface of each said adjacent element arranged in a pattern of the image atop a generally planar surface such that said beveled planes are frictionally-unlocked, each of at least a first and second of the elements comprises a plurality of integral sub-pieces forming, respectively, a first and second element, said integral sub-pieces forming said first element are each made of a different material.

5. The plurality of elements of claim 2 wherein said top surface of one of the elements is contoured, a positioning from said initial arrangement into the three-dimensional structure comprises moving at least a first and second of said adjacent elements slidably along said juxtaposed beveled planes and into said releasable friction-interlock, and said first and second adjacent elements are each made of a different material.

6. The plurality of elements of claim 1 wherein said adjacent elements of said initial arrangement comprises a first of the elements at least partially surrounded by a second of the elements, an edge-perimeter around said undersurface of said first element is greater than an edge-perimeter around said top surface thereof, and a positioning from said initial arrangement into the three-dimensional structure comprises moving said first element top surface outwardly away from said second element top surface.

7. The plurality of elements of claim 6 wherein said adjacent elements of said initial arrangement further comprises a third of the elements at least partially surrounded by said first element, an edge-perimeter around said undersurface of said third element is smaller than an edge-perimeter around said top surface thereof, said positioning from said initial arrangement further comprises moving said third element top surface downwardly from said first element top surface.

8. The plurality of elements of claim 7 so positioned into said releasable friction-interlock of the three-dimensional structure wherein said first element top surface is tiered above said second element top surface, said third element top surface is tiered below said first element top surface and above said second element top surface; the elements further adapted, upon releasing said interlock, for returning to said initial arrangement.

9. The plurality of elements of claim 1 wherein said base-thickness of a first one of the elements is greater than said base-thickness of a second one of the elements, said juxtaposed wall-surface of said first element comprises an interposed-edge between a first side-surface and said beveled plane, and said initial arrangement comprises said undersurface of each said adjacent element arranged in a pattern of the image atop a generally planar surface such that said beveled planes are frictionally-unlocked.

10. The plurality of elements of claim 9 wherein: said first side-surface is curvilinear; said adjacent elements are so arranged in said initial arrangement; and said initial arrangement comprises only a portion of said wall-surface of said first element juxtaposed and surrounded by said wall-surface of said second element, said first element having an inner wall-surface comprising a beveled plane juxtaposed and surrounding said wall-surface of a perimeter of a third one of the elements.

11. A plurality of elements arranged into a three-dimensional structure that represents an image, the structure comprising:

each of the elements has a base-thickness and comprises a top surface, an undersurface, and a wall-surface around a perimeter;

a juxtaposed wall-surface of each adjacent element comprising a beveled plane, at least a portion of which is in releasable friction-interlock;

said perimeter of each of the elements yielding the image is shaped to represent a component thereof; and said top surfaces of each element tiered with respect to its said adjacent element.

12. The structure of claim 11 wherein said wall-surfaces are beveled at an angle between 0.5-degrees to 18-degrees from vertical, and the elements are adapted for initial arrangement into a pattern of the image wherein said beveled planes of said adjacent elements are juxtaposed and frictionally-unlocked.

13. The structure of claim 12 wherein each of the elements is relatively rigid, said base-thickness of each of the elements is approximately equal, and the image is selected from the group consisting of: an image of a map, an image of a mammal, an image of a plant, an image of an inanimate object, an image of a graphic design, an image of a geographic feature, and an image of a celestial body.

14. The structure of claim 11 wherein:

said adjacent elements comprises a first of the elements at least partially surrounded by a second of the elements and a third of the elements at least partially surrounded by said first element;

in the structure said first element top surface is tiered above said second element top surface, said third element top surface is tiered below said first element top surface and above said second element top surface; and the elements adapted, upon releasing said interlock, for returning to an initial arrangement wherein said beveled planes of said adjacent elements are juxtaposed and frictionally-unlocked.

15. The structure of claim 14 wherein said second element frames the image; and said adjacent elements further comprises a fourth of the elements surrounded by said first element, in the structure said forth element is tiered below said first element top surface and above said second element top surface.

16. The structure of claim 11 wherein said adjacent elements comprises:

a first of the elements at least partially surrounded by a second of the elements, said second element interposed between said first element and a fifth element that frames the image, an edge-perimeter around said undersurface of said first element is greater than an edge-perimeter around said top surface thereof;

a third of the elements surrounded by said first element, an edge-perimeter around said undersurface of said third element is smaller than an edge-perimeter around said top surface thereof; and a fourth of the elements surrounded by said first element, an edge-perimeter around said undersurface of said fourth element is smaller than an edge-perimeter around said top surface thereof.

17. The structure of claim 16 wherein said first element top surface is tiered above said second element top surface, said second element top surface is tiered above said fifth element, each of said third element top surface and said fourth element top surface is tiered below said first element top surface and above said fifth element top surface.

18. A method of arranging a plurality of relatively rigid elements into a three-dimensional structure that represents an image, the method comprising the steps of:

providing each of the elements with a top surface, an undersurface, and a wall-surface around a perimeter, whereby said perimeter of each of the elements yielding the image is shaped to represent a component of the image;

initially arranging the elements such that a beveled plane of said wall-surface of each adjacent element are juxtaposed; and slidably positioning the elements along said juxtaposed beveled planes into a releasable frictional-interlock of the structure wherein said top surface of each said adjacent element is tiered with respect to said adjacent element.

19. The method of claim 18 wherein:

said step of initially arranging the elements further comprises arranging said undersurface of each said adjacent element into a pattern of the image such that said beveled planes are frictionally-unlocked, placing a second of the elements to at least partially surround a first of the elements and a third of the elements to be surrounded by said first element; and said step of slidably positioning further comprises moving said adjacent elements such that said first element top surface is tiered above said second element top surface and said third element top surface is tiered below said first element top surface and above said second element top surface.

20. The method of claim 19 wherein said step of slidably positioning further comprises moving said adjacent elements such that a fourth element top surface is tiered below said first element top surface and above said second element top surface; and further comprising the step of, upon releasing said frictional-interlock, returning the elements to said frictionally-unlocked initial arrangement.

21. The method of claim 18 wherein said step of providing further comprises, prior to said step of initially arranging, beveling each said plane of said juxtaposed wall-surfaces at an angle between 0.5-degrees and 18-degrees from vertical, whereby each said beveled plane extends around a respective perimeter and at least approximately one-third the length between said top surface and said undersurface of a respective one of said juxtaposed wall-surfaces.

* * * * *